US005329565A

United States Patent [19]

Moore

[11] Patent Number: 5,329,565

[45] Date of Patent: Jul. 12, 1994

[54] STAYROD ARRANGEMENT

[75] Inventor: Jay T. Moore, Milton, Fla.

[73] Assignee: Westinghouse Electric Corporation, Pittsburgh, Pa.

[21] Appl. No.: 137,358

[22] Filed: Oct. 18, 1993

[51] Int. Cl.[5] ..... G21C 15/00

[52] U.S. Cl. ..... 376/402; 376/310

[58] Field of Search ..... 376/310, 402, 371; 122/512; 165/69

[56] References Cited

U.S. PATENT DOCUMENTS

| | | | |
|---|---|---|---|
| 4,079,701 | 3/1976 | Hickman et al. | 122/382 |
| 4,415,021 | 11/1983 | Bayless et al. | 165/76 |
| 4,576,068 | 3/1986 | Glatthorn | 82/1.4 |
| 4,653,576 | 3/1987 | Legally | 165/69 |
| 4,676,201 | 7/1987 | Lahoda et al. | 122/392 |
| 4,704,994 | 11/1987 | Hu et al. | 122/32 |
| 4,777,911 | 10/1988 | Wepfer | 122/512 |
| 5,069,172 | 12/1991 | Shirey et al. | 122/382 |

*Primary Examiner*—Donald P. Walsh
*Assistant Examiner*—Meena Chelliah
*Attorney, Agent, or Firm*—Walter S. Stevens

[57] ABSTRACT

Stayrod arrangement for enhancing removal of sludge from nuclear heat exchangers. The stayrod arrangement includes a rod disposed adjacent a plurality of heat exchange tubes defining a tube lancing lane therebetween, the tube lane having sludge deposits therein. The rod has planer side portions oriented parallel to the direction of a fluid stream intended to flush the sludge deposits from the tube lane. An anti-rotation connector is connected to the rod for fixing the orientation of the rod with respect to the fluid stream.

15 Claims, 13 Drawing Sheets

STAYROD ARRANGEMENT

BACKGROUND

This invention generally relates to stayrods, and more particularly relates to a stayrod arrangement for enhancing removal of sludge from nuclear heat exchangers.

Although stayrods for use in nuclear heat exchangers are known in the prior art, these stayrods have a number of problems associated with them that interfere with sludge removal operations. However, before these problems can be appreciated, some background is desirable as to the structure and operation of a typical nuclear heat exchanger and its associated stayrods.

In this regard, a typical nuclear heat exchanger or steam generator generates steam when heat is transferred from a heated and radioactive primary fluid to a non-radioactive secondary fluid of lower temperature. The primary fluid flows through a plurality of U-shaped tubes, which are received through holes in a plurality of spaced-apart support plates and also through holes in a tubesheet disposed in the heat exchanger. The secondary fluid is caused to surround the exterior surfaces of the tubes as the primary fluid flows through the tubes. The walls of the tubes function as heat conductors for transferring heat from the heated primary fluid to the secondary fluid. Thus, as the primary fluid flows through the tubes, it gives up its heat to the secondary fluid surrounding the exterior surfaces of the tubes to produce steam that is used to generate electricity in a manner well known in the art.

Because the primary fluid is radioactive, the nuclear heat exchanger is designed such that the radioactive primary fluid flowing through the tubes does not commingle with and radioactively contaminate the nonradioactive secondary fluid surrounding the exterior surfaces of the tubes. Radioactive contamination of the secondary fluid is undesirable for safety reasons. Therefore, the tubes are designed to be leak-tight so that the radioactive primary fluid remains separated from the nonradioactive secondary fluid to avoid commingling the primary fluid with the secondary fluid. However, the previously mentioned support plates are subject to deflection or bowing during postulated accident scenarios (e.g., main streamline break). Although highly unlikely, such deflection or bowing conceivably may cause the support plates to wear against and conceivably breach the walls of the tubes extending through the holes of support plates, which breach in turn may cause the radioactive primary fluid to commingle with the nonradioactive secondary fluid. Therefore, a plurality of elongate stayrods interconnect the support plates with the tubesheet to prevent deflection or bowing of the support plates. In addition, each stayrod is surrounded by a tubular spacer interposed between adjacent support plates to assist in maintaining the support plates in their nondeflected spaced-apart relationship.

Moreover, the secondary fluid entering the heat exchanger may contain suspended particles that precipitate-out of the secondary fluid and accumulate on the surface of the tubesheet as sludge. This accumulation of sludge is undesirable because it can lead to thinning of the walls of the tubes, which thinning conceivably may ultimately cause a breach of the tube walls allowing the primary fluid to commingle with the secondary fluid, a highly undesirable result. Such thinning may preferentially occur near the elevation of the tubesheet at a height corresponding to the height of sludge that has accumulated on the tubesheet. The sludge itself is primarily a combination of iron oxides and copper compounds together with trace amounts of other metals that have settled-out of the secondary fluid and onto the tubesheet. It is believed by applicant that such sludge deposits on the tubesheet may provide sites for concentration of phosphates or other corrosive agents at the tube wall in amounts sufficient to cause the previously mentioned tube wall thinning.

Therefore, such nuclear heat exchangers are typically serviced during shutdown periods to remove the sludge deposits on the tubesheet. Servicing of the heat exchanger involves opening inspection port covers located near the elevation of the tubesheet and inserting a fluid lancing tool therethrough, which fluid lancing tool emits at least one jet of high pressure fluid into the respective lanes defined between the tubes for dislodging the sludge from the tubesheet surface. In this regard, the fluid lancing tool is moved along the tubesheet while the jet of high pressure fluid is directed perpendicularly with respect to the movement of the fluid lancing tool. The high pressure fluid entrains the sludge in a flow of fluid which is then suctioned from the tubesheet. Such a sludge removal system is more fully described in U.S. Pat. No. 4,079,701 titled "Steam Generator Sludge Removal System" issued Mar. 21, 1978 in the name of Robert A. Hickman, et al. and assigned to the assignee of the present invention.

However, the previously mentioned prior art stayrods with their surrounding spacers may impede lancing some areas of the tubesheet because the spacers have a diameter larger than the tubes and therefore effectively block some of the fluid lancing lanes. Blocking of the fluid lancing lanes interferes with removing a portion of sludge from the heat exchanger. This is undesirable because leaving sludge residue in the heat exchanger after servicing may ultimately lead to the previously mentioned tube wall thinning, which thinning in turn may ultimately lead to the radioactive primary fluid commingling with the nonradioactive secondary fluid. Consequently, a problem in the art is to remove as much sludge as possible from the tubesheet even in the presence of stayrods and spacers.

Stayrods facilitating sludge removal are known. Such a stayrod is disclosed in U.S. Pat. No. 4,777,911 titled "Stayrod Configuration For Facilitating Steam Generator Sludge Lancing" issued Oct. 18, 1988 in the name of Robert M. Wepfer and assigned to the assignee of the present invention. This patent discloses a stayrod configuration which facilitates fluid lancing of the tubesheet, the stayrod configuration including a plurality of stayrods, each having the same diameter as the tubing and being threaded into the tubesheet at spaced positions which match the tube pattern. Although the stayrod configuration disclosed in this patent allows the removal of a relatively large amount of sludge from the lanes defined by the tubes, its use is nonetheless less than completely satisfactory. That is, although the plurality of stayrods disclosed in this patent each has the same diameter as the tubes, each group of stayrods appear to present a relatively large cumulative transverse profile to the fluid emitted from the lance, which profile may undesirably interfere with the ability of the fluid lance to completely remove the sludge from the lanes.

Hence, although stayrods for facilitating sludge removal are known in the art, the prior art does not appear to disclose a stayrod arrangement for suitably enhancing removal of sludge from nuclear heat exchangers.

Therefore, what is needed is a stayrod arrangement for enhancing removal of sludge from nuclear heat exchangers.

SUMMARY

Disclosed herein is a stayrod arrangement for enhancing removal of sludge from nuclear heat exchangers. The stayrod arrangement includes a rod disposed adjacent a plurality of heat exchange tubes defining a tube lane therebetween, the tube lane having sludge deposits therein. The rod has planer side portions oriented parallel to the direction of a fluid stream intended to flush the sludge deposits from the tube lane. An anti-rotation connector is connected to the rod for fixing the orientation of the rod with respect to the fluid stream.

In its broad form, the invention resides in a stayrod arrangement for enhancing removal of sludge from a lane having sludge therein and defined between a plurality of spaced-apart structures, the stayrod arrangement adapted to reduce blockage of a fluid directed toward the lane comprising a rod disposed adjacent the structures and having a planer side oriented parallel to the direction of the fluid for allowing the fluid past the planer side and into the lane for flushing the sludge from the lane.

An object of the present invention is to provide a stayrod arrangement for enhancing removal of sludge from nuclear heat exchangers.

Another object of the invention is to provide an adjustable stayrod arrangement.

A feature of the present invention is the provision of a rod disposed adjacent a plurality of heat transfer tubes defining a tube lane therebetween in the heat exchanger, the tube lane having sludge therein and the rod having parallel planer side portions oriented parallel to the direction of flow of a fluid stream intended for flushing the sludge from the tube lane, the side portions allowing the fluid stream past the side portions and into the tube lane to flush the sludge from the tube lane.

An advantage of the present invention is that relatively more sludge is removed from the tube lane by the fluid stream because the configuration of the stayrod will not substantially block the fluid stream directed toward the tube lane.

Another advantage of the present invention is that the stayrod arrangement is adjustable so as to accommodate different designs of heat exchangers.

These and other objects, features and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

While the specification concludes with claims particularly pointing out and distinctly claiming the subject matter of the invention, it is believed the invention will be better understood from the following description taken in conjunction with the accompanying drawings wherein:

DESCRIPTION OF THE PREFERRED EMBODIMENTS

Figure 1:
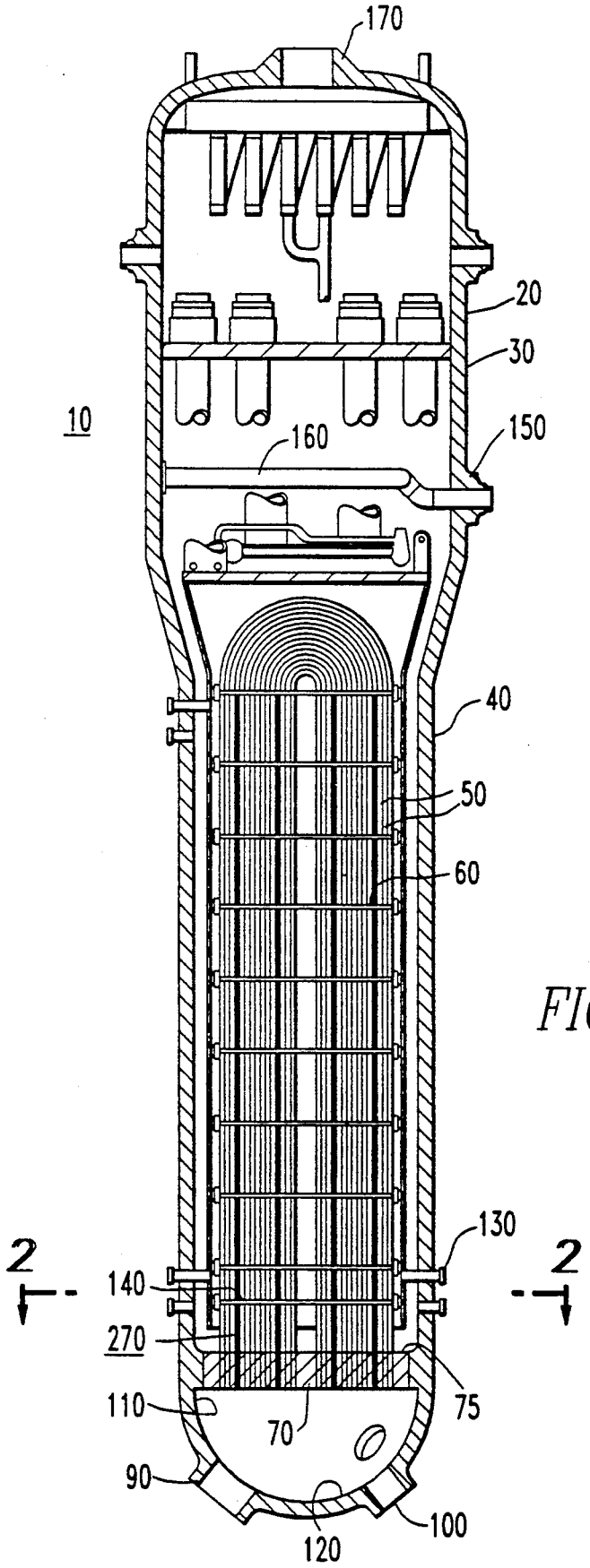
FIG. 1 shows in partial elevation a typical nuclear heat exchanger with parts removed for clarity, the heat exchanger having a tubesheet,-baffle plate disposed above the tubesheet and a plurality of the support plates disposed therein for supporting a plurality of U-shaped heat transfer tubes, and also having disposed therein a plurality of elongate stayrods interconnecting the support plates with the baffle plate and tubesheet.

Referring to FIG. 1, there is shown a typical nuclear heat exchanger or steam generator, generally referred to as 10, for generating steam. Heat exchanger 10 comprises a shell 20 having an upper portion 30 and a lower portion 40. Disposed in lower portion 40 are a plurality of spaced-apart structures, such as vertically-oriented and inverted U-shaped heat transfer tubes 50, for circulating radioactive primary fluid (not shown) therethrough. Tubes 50 are arranged in repeating predetermined pattern or array so as to define a plurality of tube lanes 55 therebetween (see FIG. 4). As shown in FIG. 1, each tube 50 extends through its respective holes (not shown) formed in a plurality of horizontally-oriented support plates 60 intended for laterally supporting tubes 50. Disposed in lower portion 40 and attached thereto is a horizontally-oriented first plate member or tubesheet 70 having a plurality of apertures 80 (see FIG. 3) therethrough for receiving the end portions of tubes 50 and a plurality of internally threaded bores 85 therein for reasons disclosed hereinbelow. Tubesheet 70 also has a top surface 75 on which contaminants or sludge deposits 77 may preferentially form, as described more fully hereinbelow. This sludge 77 accumulates or deposits in tube lanes 55 on top surface 75.

Still referring to FIG. 1, disposed on shell 20 are a first inlet nozzle 90 and a first outlet nozzle 100 in fluid communication with an inlet plenum chamber 110 and an outlet plenum chamber 120, respectively. A plurality of inspection ports 130 (only four of which are shown)

are formed through shell 20 above tubesheet 70 for providing access to the top surface 75 of tubesheet 70. Moreover, spaced above tubesheet 70 but below the bottom-most support plate 60 is a horizontally-oriented second plate member or baffle plate 140, which may be 400 Series stainless steel, preferably having a centrally disposed opening (not shown) for allowing the secondary fluid to sweep over top surface 75 and upwardly through the opening for reducing the amount of sludge 77 accumulating on tubesheet 70. Baffle plate 140 may also have a plurality of bores 145 therethrough (see FIG. 3), each bore 145 defining an annular ledge 147 and a polygonally-shaped recess 148 therein for reasons disclosed more fully hereinbelow. Moreover, baffle plate 140 may have a plurality of apertures 149 for receiving tubes 50 therethrough (see FIG. 3). As shown in FIG. 1, formed through shell 20 above tubes 50 is a second inlet nozzle 150, which is connected to a perforated feedring 160 disposed in upper portion 30 for allowing entry of the nonradioactive secondary fluid into upper portion 30. The secondary fluid, which may be demineralized water with suspended particulate matter entrained therein, will flow into upper portion 30 through second inlet nozzle 150 and through the perforations (not shown) of feedring 160. A second outlet nozzle 170 is attached to the top of upper portion 30 for exit of the steam from heat exchanger 10.

Figure 2:
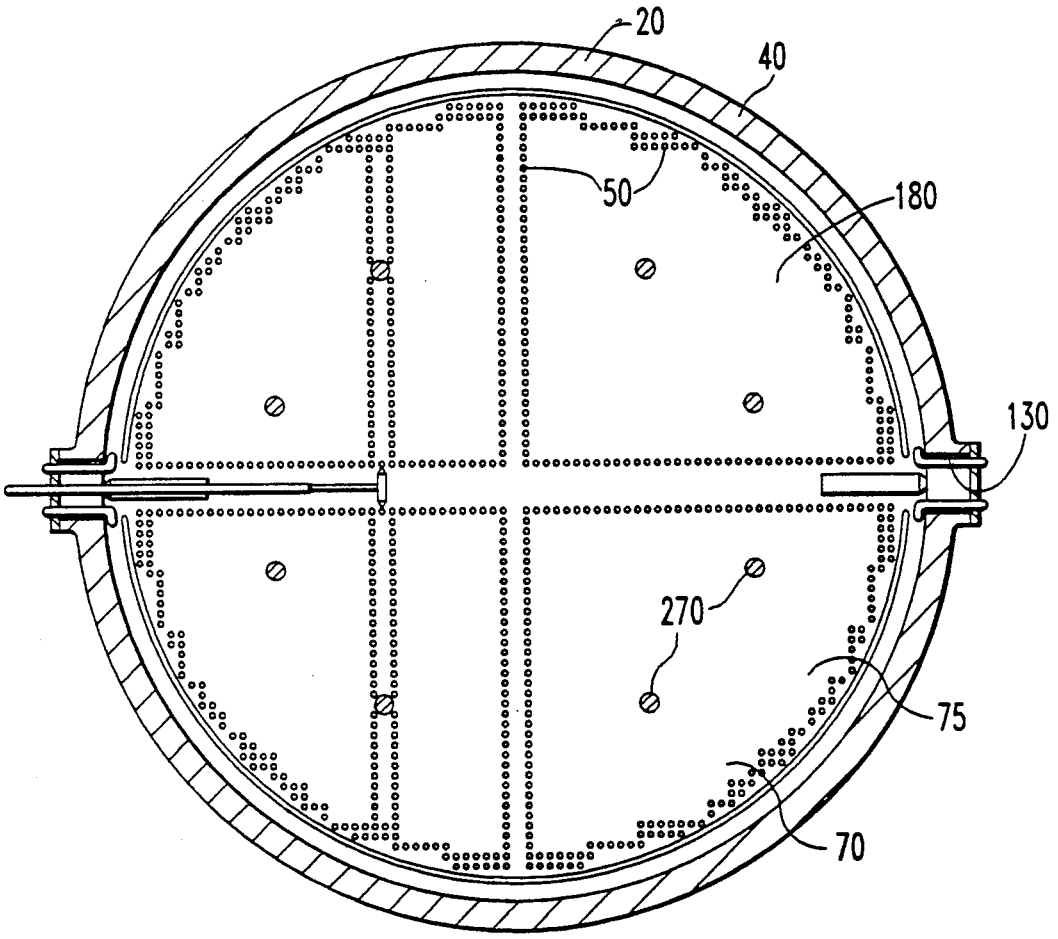
FIG. 2 is a view taken along section line 2—2 of FIG. 1.

Referring to FIGS. 1 and 2, due to the inverted U-shape of tubes 50, a straight line section of tubesheet 70 is without tubes 50 therein. This straight line section is generally designated in the several figures as a center tube lane 180. The previously mentioned inspection ports 130, which may be about two inches in diameter, may be provided diametrically opposite each other and in collinear alignment with center tube lane 180. In addition, two additional inspection ports 130 may be provided on lower portion 40 of shell 20 at 90° with respect to tube lane 180. Inspection ports 130 allow access to top surface 75 of tubesheet 70 for reasons disclosed hereinbelow. Moreover, a plurality of six inch diameter handholes (not shown) may also be provided for allowing access to the interior of heat exchanger 10.

During operation of heat exchanger 10, radioactive primary fluid, heated by a nuclear heat source (not shown), flows through first inlet nozzle -90, into inlet plenum chamber 110, and through tubes 50 to outlet plenum chamber 120 where the primary fluid exits heat exchanger 10 through first outlet nozzle 100. As the primary fluid enters inlet plenum chamber 110, the secondary fluid simultaneously enters second inlet nozzle 150 to flow through the perforations of feedring 160 and into upper portion 30 of shell 20. As the secondary fluid flows into shell 20, it will eventually surround tubes 50. A portion of this secondary fluid vaporizes into steam due to conductive heat transfer from the primary fluid to the secondary fluid, the conductive heat transfer occurring through the walls of tubes 50. This steam exits heat exchanger 10 through second outlet nozzle 170 and is piped to a turbine-generator set (not shown) to generate electricity in a manner well known in the art.

In addition, during operation of heat exchanger 10, the previously mentioned sludge 77, which settles-out of the secondary fluid, will tend to preferentially accumulate on top surface 75 of tubesheet 70. Although baffle plate 140 and its associated opening (not shown) assists in preventing sludge 77 from accumulating on tubesheet 70, some sludge 77 will nonetheless deposit on tubesheet 70. Such sludge 77 may ultimately cause thinning of the wall of any tube 50, that comes into prolonged contact with it, which tube wall thinning may allow the radioactive primary fluid to commingle with the nonradioactive secondary fluid, a highly undesirable result. Therefore, it is important to remove any such sludge 77 from top surface 75 of tubesheet 70. Therefore, to remove this accumulated sludge, inspection ports 130 are opened to provide access to the top surface 75 of tubesheet 70 and a fluid lance 190 is introduced into heat exchanger 10 through one of the inspection ports 130. As fluid lance 190 is introduced through one of inspection ports 190, a suction header 200 is inserted through the inspection port 130 diametrically opposite the inspection port 130 through which the fluid lance 190 has been introduced. Fluid lance 190 is then moved or translated along center tube lane 180, emitting a fluid stream (e.g., water or a water-solvent mixture), which fluid stream is designated in the several figures as 210. This fluid stream 210 is directed toward the tube lanes 55 defined between tubes 50 to dislodge or remove the sludge 77 therefrom which may have accumulated in tube lanes 55 during operation of heat exchanger 10. Such a sludge removal system is more fully disclosed in U.S. Pat. No. 4,079,701 titled "Steam Generator Sludge Removal System" issued Mar. 21, 1978 in the name of Robert A. Hickman, et al. and assigned to the assignee of the present invention, the disclosure of which is hereby incorporated by reference.

However, in the prior art, the plurality of vertically-oriented stayrods that interconnect support plates 60 and baffle plate 140 to tubesheet 70 in order to mitigate bowing or deflection in support plate 60 and baffle plate 140, may interfere with removing sludge 77 from sludge lanes 55, as described more fully hereinbelow.

Figure 2A:
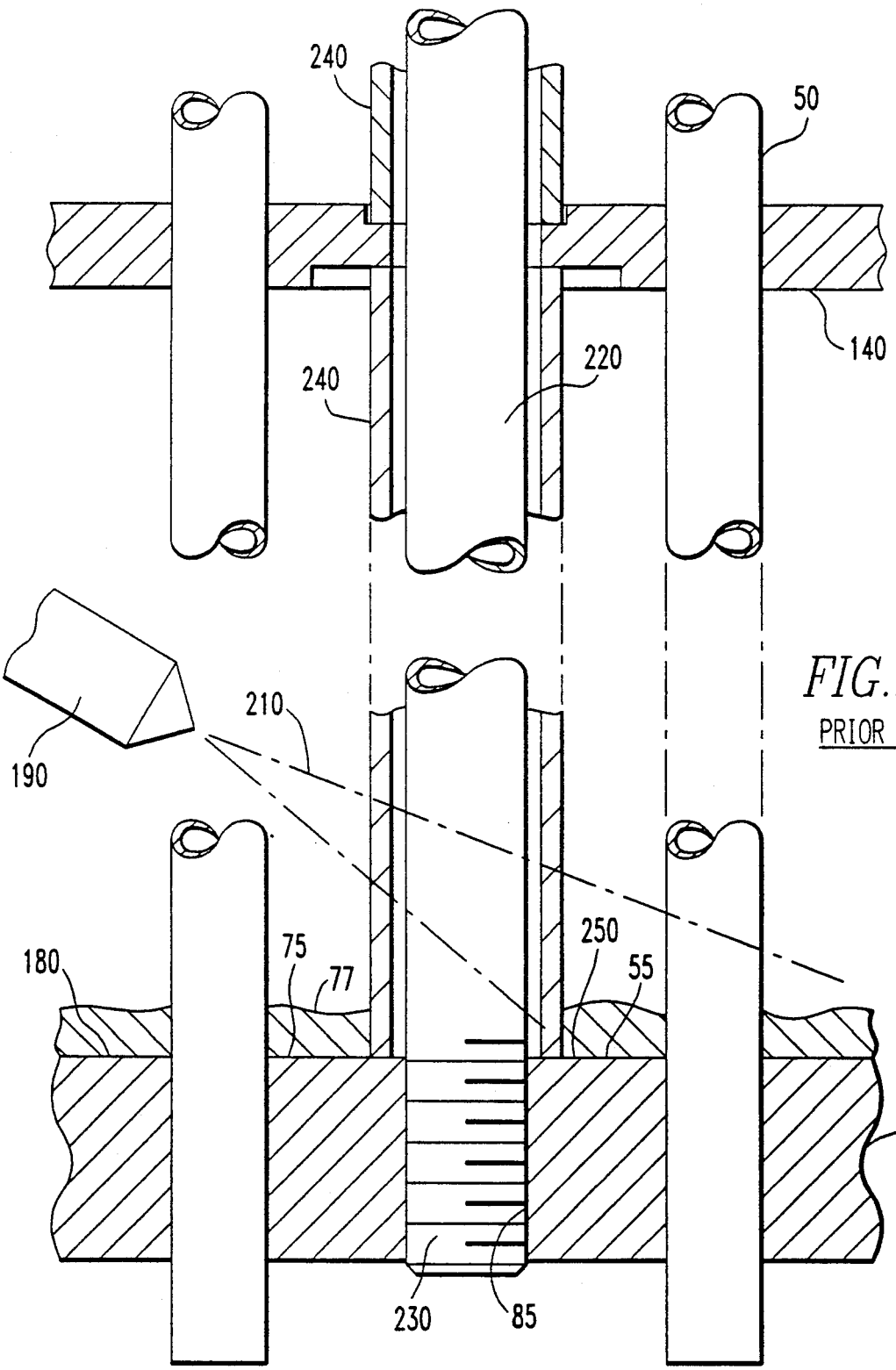
FIG. 2A PRIOR ART
FIG. 2A is a view in partial elevation of the baffle plate disposed above the tubesheet, the baffle plate and tubesheet interconnected by a prior art full length stayrod surrounded by a spacer, the tubesheet having sludge thereon, this view also showing a fluid lance directing a fluid stream toward the sludge, the stayrod and spacer interfering with the fluid stream.

Referring to FIG. 2A, a plurality of prior art full length stayrods 220 each has a threaded end 230 threadably engaging its respective threaded bore 85. Surrounding this prior art stayrod 220 is a tubular spacer 240 fitted between baffle plate 140 and tubesheet 70 for maintaining baffle plate 140 and tubesheet 70 in their predetermined spaced-apart relationship. A plurality of such spacers 240 are also fitted between adjacent support plates 60 for maintaining the adjacent support plates 60 in their predetermined spaced-apart relationship. Stayrod 220 has a larger diameter than tube 50 and occupies, along with its associated spacer 240, the same area as four tubes 50. Thus, stayrod 220 and spacer 240 effectively cause blockage of tube lane 55. This blockage will interfere with the flushing of sludge 77 from portions 250 of tube lane 55 located behind each prior art stayrod 220. Blockage of tube lane 55 is undesirable because such blockage will necessarily result in less than the desired amount of sludge 77 being removed from tube lane 55 during the fluid lancing process. Therefore, a problem in the art is to provide a stayrod configuration that does not evince such blockage of tube lane 55. According to the invention, this problem is solved by the provision of a stayrod arrangement for enhancing removal of sludge from nuclear heat exchangers.

Therefore, referring to FIGS. 3, 3A, 4 and 5, there is shown the subject matter of the present invention, which is a stayrod arrangement, generally referred to as 260, for enhancing removal of sludge from nuclear heat exchanger 10. Stayrod arrangement 260 comprises a plurality of elongate generally cylindrical rods 270, which may be carbon steel, disposed at predetermined locations adjacent tubes 50 in such a manner as to match the predetermined pattern or pitch of tubes 50. Each rod 270 has an externally threaded proximal end portion 280 capable of threadably engaging its respective internally threaded bore 85 formed in tubesheet 70. In addition, each rod 270 has an externally threaded distal end portion 290 for reasons provided hereinbelow. The terminology "proximal end portion" is defined herein to mean that end portion nearer plenum chambers 110/120 and the terminology "distal end portion" is defined herein to mean that end portion further away from plenum chambers 110/120. Interposed between proximal end portion 180 and distal end portion 290 of rod 270 is an integrally attached intermediate portion 300. Intermediate portion 300 has oppositely disposed parallel planer side portions 310*a* and 310*b* defining a mid-portion 320 of predetermined thickness or width "A" therebetween. Width "A" is sized to allow the fluid stream 210 past side portions 310*a*/310*b* of rod 270 and into tube lanes 55 to flush sludge 77 therefrom. In this manner, rod 270 does not block tube lanes 55.

Still referring to FIGS. 3, 3A, 4 and 5, a generally tubular anti-rotation connector 330 is interposed between tubesheet 70 and baffle plate 140 and has a proximal end portion 340, a distal end portion 350 and an internally threaded bore 355 longitudinally therethrough. Distal end portion 290 of rod 270 threadably engages internally threaded bore 355 of connector 330. Moreover, distal end portion 350 of connector 330 has a polygonally-shaped washer 360 integrally attached thereto, such as by weldments 370. Washer 360 is preferably "INCONEL" and connector 330 is preferably made of carbon steel. It will be appreciated that welding connector 330, which may be formed of carbon steel, directly to baffle plate 140, which may be stainless steel, is not preferred in order to obviate the need to heat treat the stainless steel after welding. To overcome this problem, "INCONEL" washer 360 is provided so that carbon steel connector 330 may be suitably welded thereto to connect connector 330 to baffle plate 140 without requiring the welding of carbon steel to stainless steel. In a similar manner, carbon steel rod 270 may be integrally connected to carbon steel connector 330, such as by weldments 375. Polygonally-shaped washer 360 is matingly received in polygonally-shaped recess 148. It therefore will be appreciated from the description hereinabove, that the mating engagement of washer 360 with recess 148 ensures that connector 330 is incapable of rotating about its longitudinal axis for reasons disclosed in more detail hereinbelow.

Figure 3:
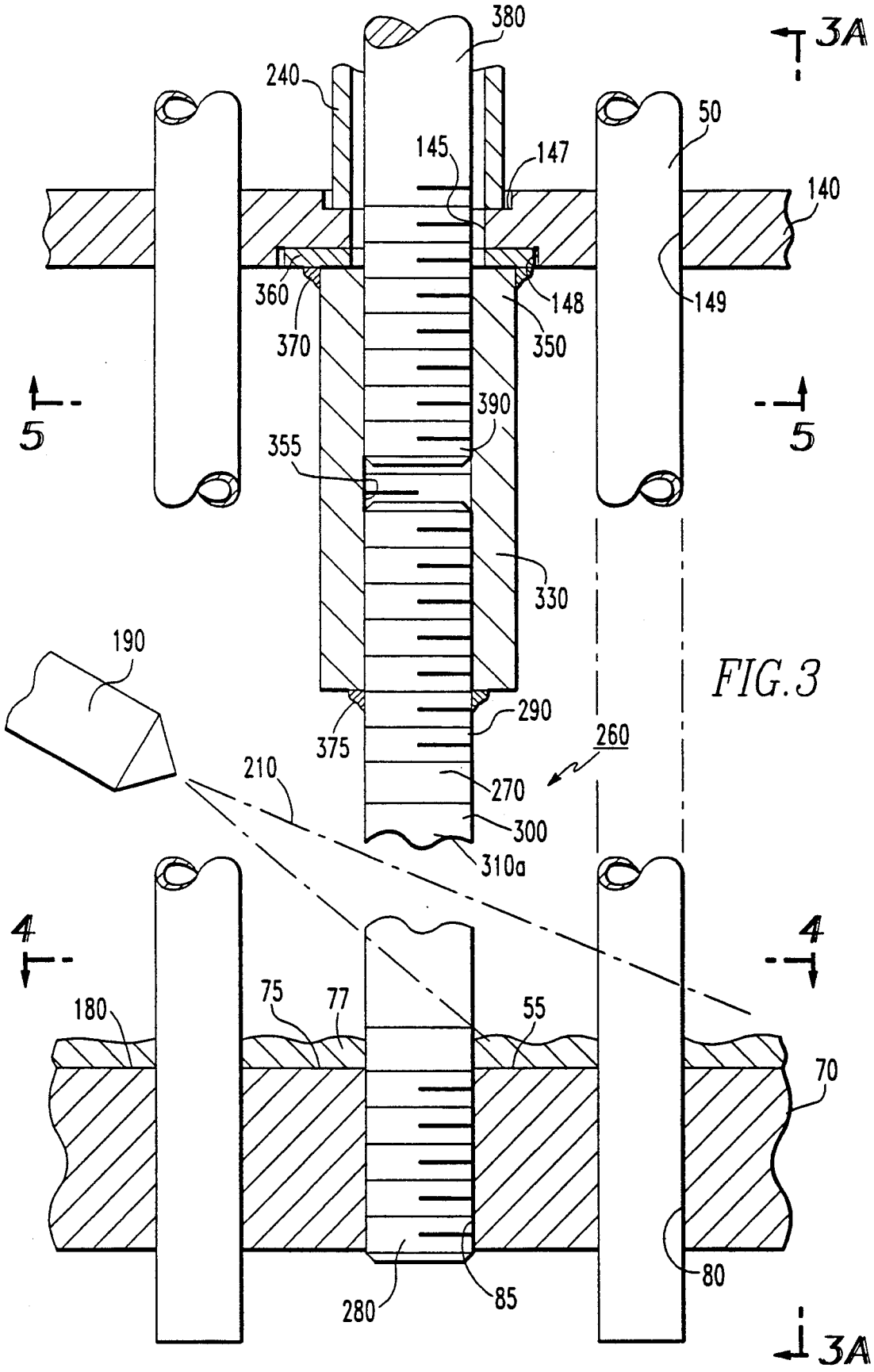
FIG. 3 is a view showing in partial elevation the baffle plate disposed above the tubesheet, the baffle plate and tubesheet interconnected by a stayrod arrangement of the present invention, the tubesheet having the sludge thereon, this view also showing a fluid lance directing a fluid stream toward the sludge.
Figure 3A:
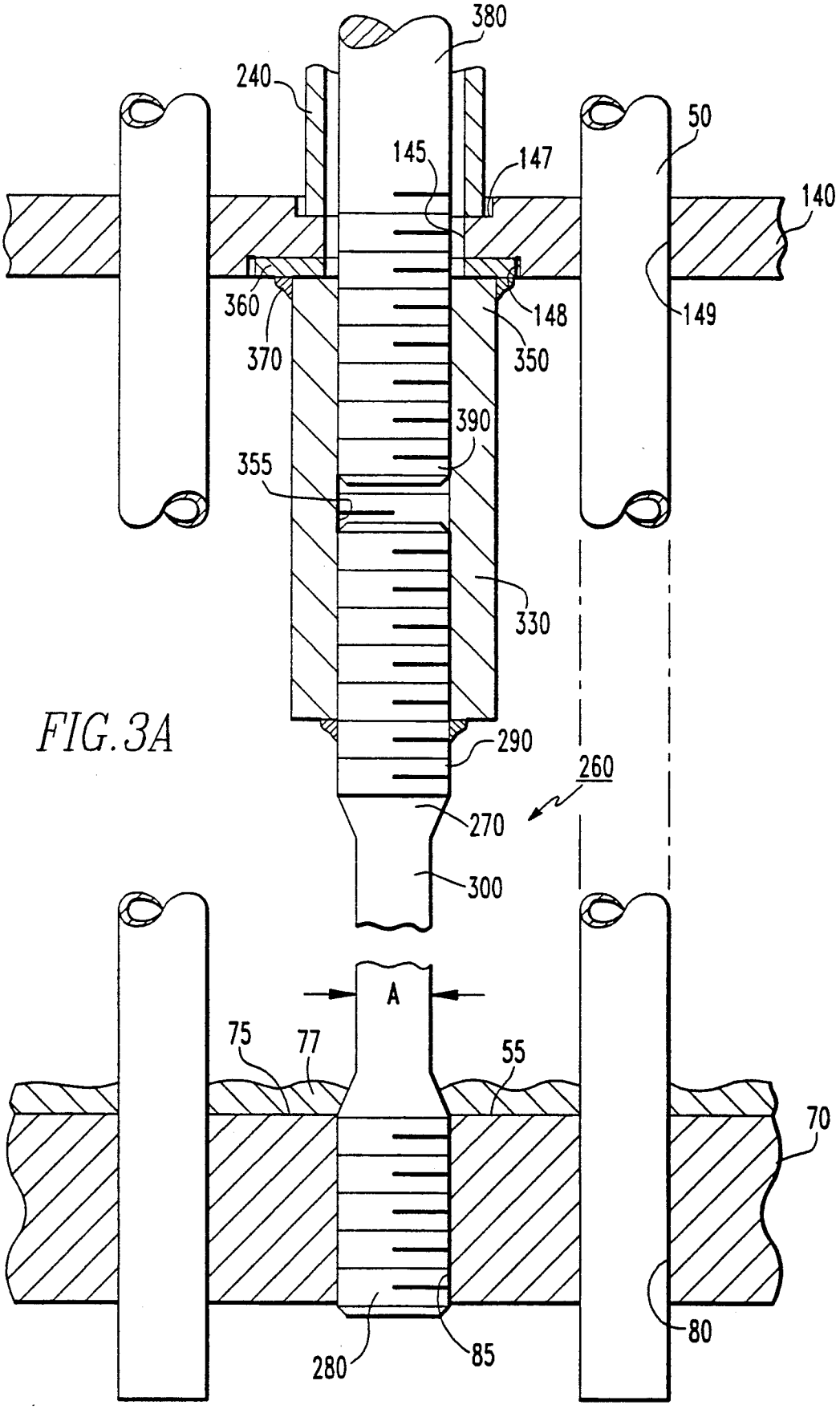
FIG. 3A is a view taken along section line 3A—3A of FIG. 3.
Figure 4:
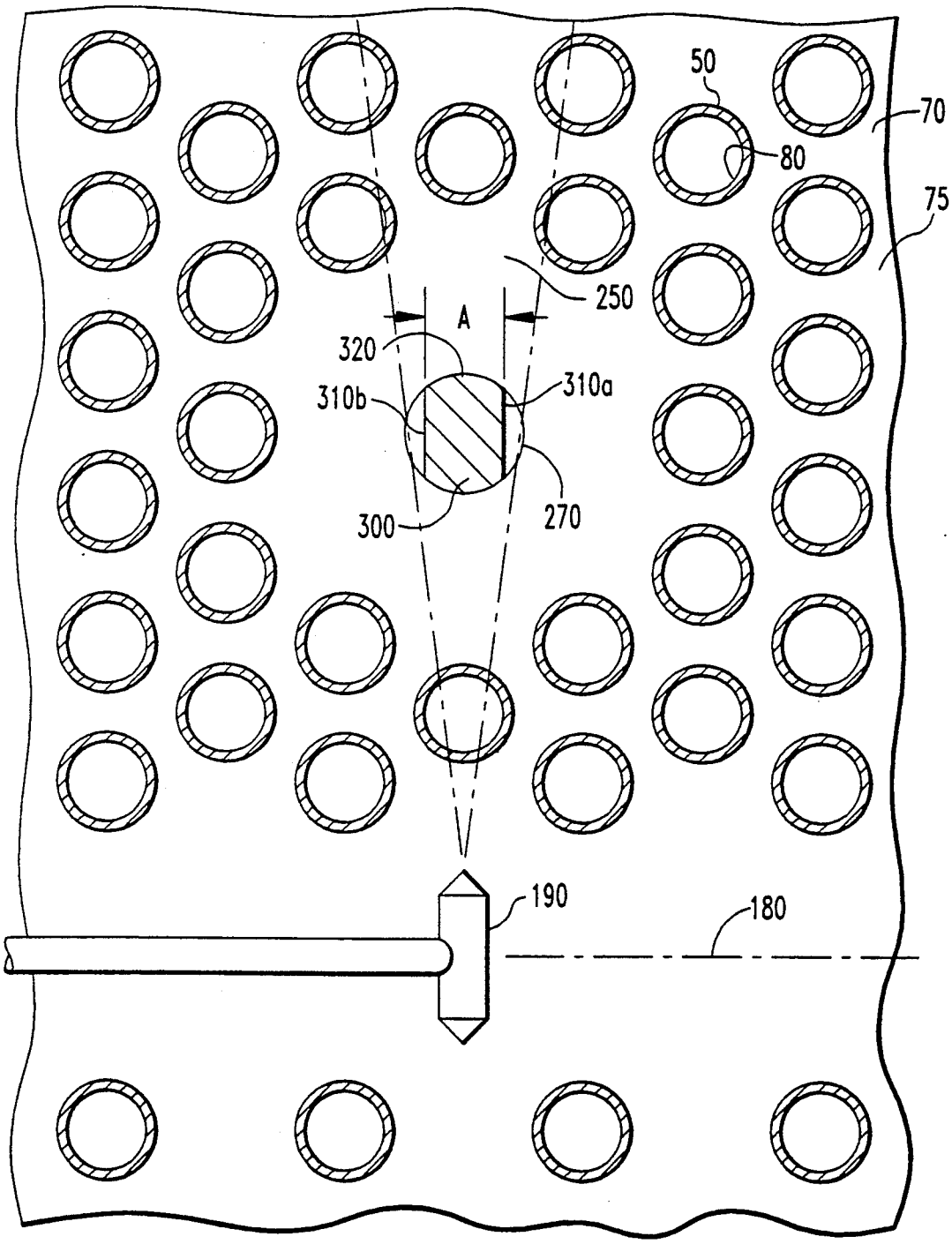
FIG. 4 is a view along section line 4—4 of FIG. 3.
Figure 5:
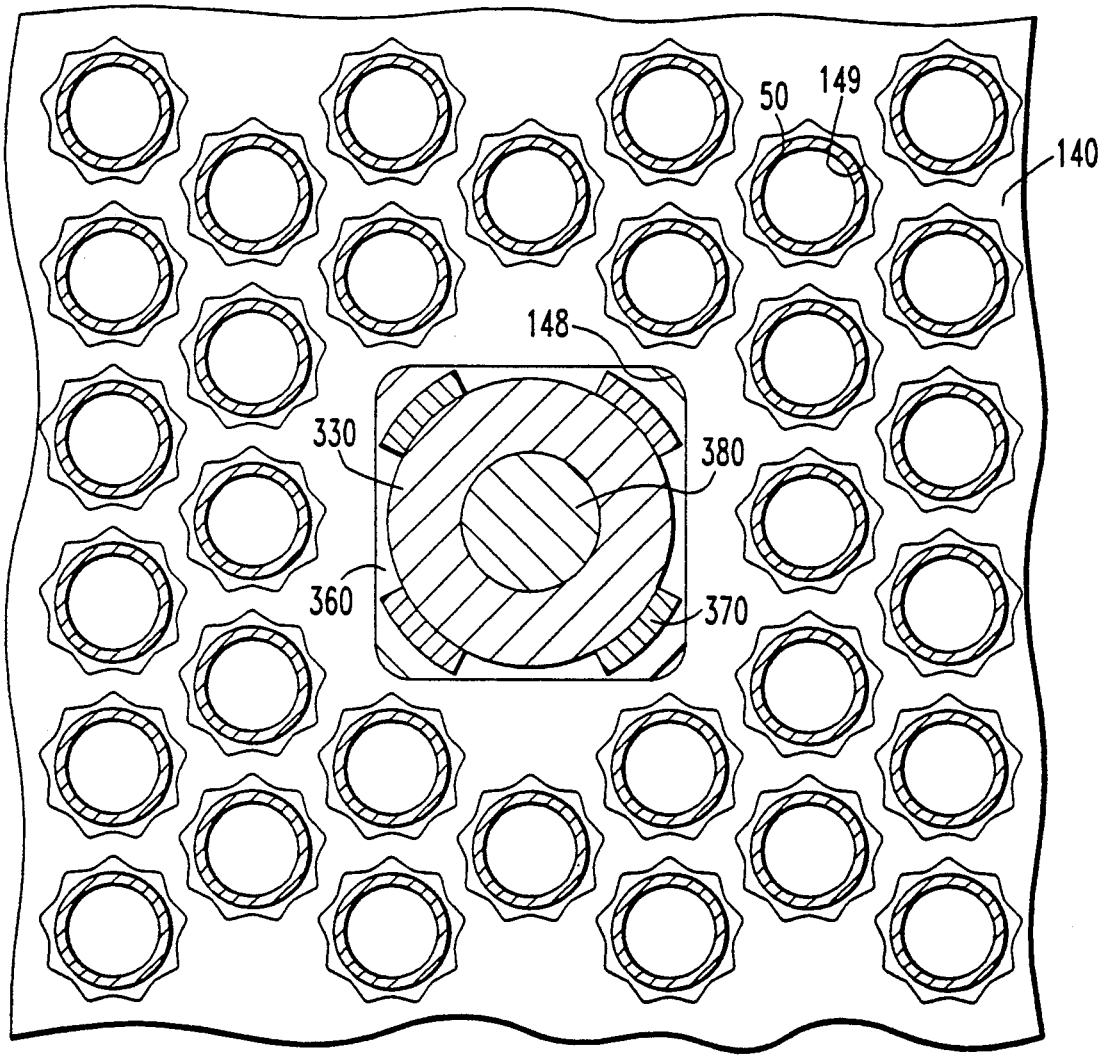
FIG. 5 is a view along section line 5—5 of FIG. 3.

As best seen in FIG. 3, connector 330 is suspended and downwardly extends from baffle plate 140 to a predetermined axial elevation that is short of the predicted height or level of sludge deposits 77 in order not to impede or block fluid stream 210 accessing tube lane 55. Moreover, it will be understood from the description hereinabove that there is no spacer 240 between baffle plate 140 and tubesheet 70 for allowing fluid steam 210 access to tube lane 55.

Referring yet again to FIGS. 3, 3A, 4, and 5, another rod 380 of length shorter than prior art stayrod 220 has an externally threaded proximal end portion 390 extending through bore 145 of baffle plate 140 in order to threadably engage internally threaded bore 355 of connector 330. The threaded engagement of rod 380 with bore 355 of connector 330 threadably interconnects tubesheet 70 with support plates 60 and baffle plate 140 to prevent the previously mentioned deflection or bowing in support plates 60 and baffle plate 140. Thus, it will be appreciated from the description hereinabove, that shortened elongate rods 380 in combination with connectors 330 interconnect baffle plate 140 and all the support plates 60 with tubesheet 70. It will be further appreciated from the description hereinabove that the stayrod arrangement of the present invention is adjustable so as to customize the length of rod 270 to accommodate different heights of baffle plate 140 above tubesheet 70 caused by different designs of heat exchanger 10. In this regard, prior to making the weldments (e.g., weldments 370) connecting connector 330 to washer 360 and to rod 270, connector 330 is rotated as bore 355 thread engages rod 270 and shortened rod 380 until distal end portion 350 of connector 300 firmly abuts washer 360. After this adjustment is performed, the weldments are made. It also will be appreciated from the description hereinabove that the spacer 240 which is interposed between the lower-most support plate 60 and baffle plate 140 surrounds rod 380 and has a lower end thereof resting on ledge 147 to support spacer 240 as spacer 240 maintains baffle plate 140 and the lower-most support plate 60 in their predetermined spaced-apart relationship.

Figure 6:
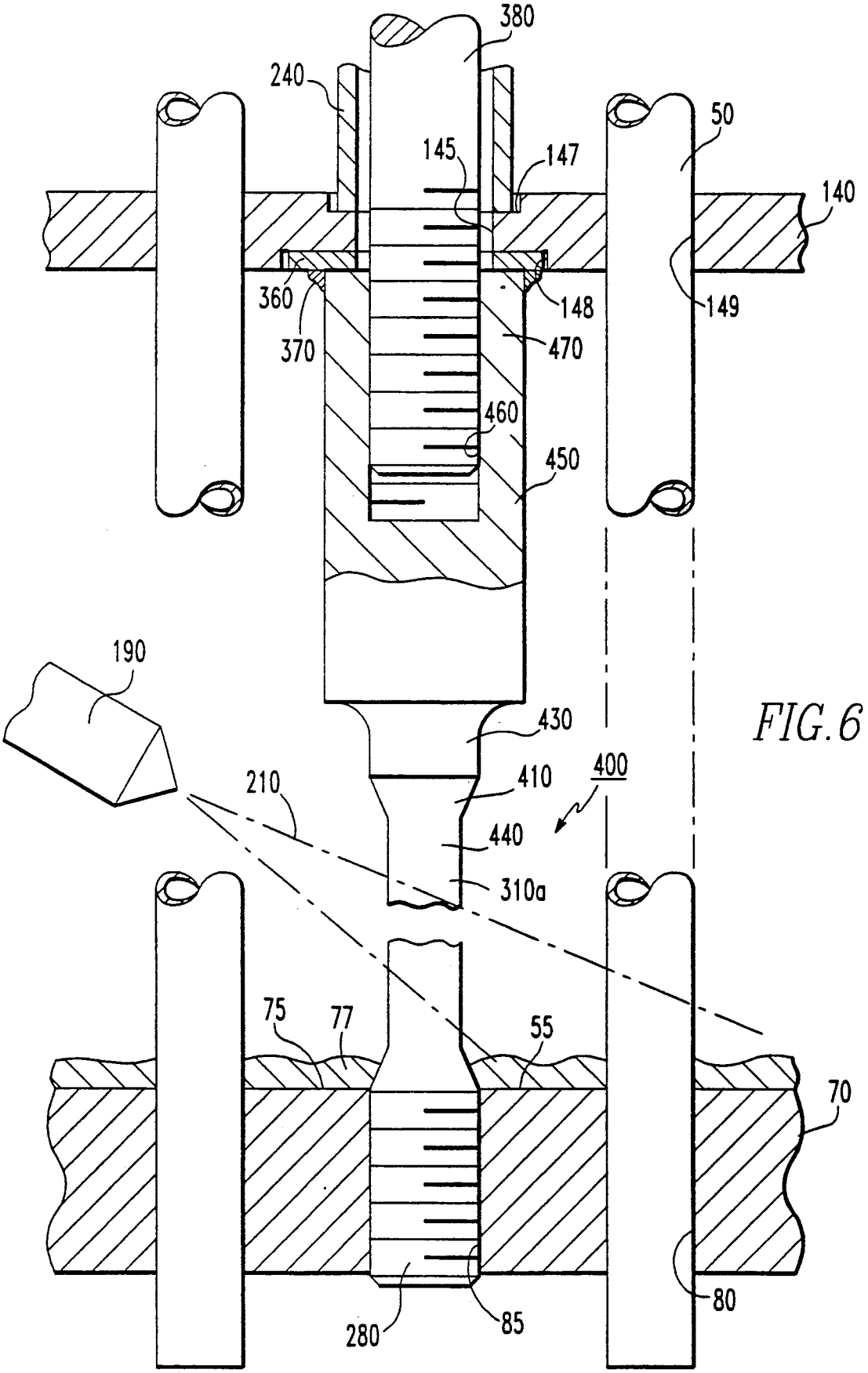
FIG. 6 is a view in partial elevation of an alternative embodiment of the stayrod arrangement belonging to the present invention.

Turning to FIG. 6, there is shown a second embodiment of the present invention, which is a second embodiment stayrod arrangement, generally referred to as 400, for enhancing removal of sludge from heat exchanger 10. Second embodiment stayrod arrangement 400 comprises a plurality of elongate generally cylindrical rods 410 disposed at predetermined locations adjacent tubes 50. Each rod 410 has an externally threaded proximal end portion 420 capable of threadably engaging its respective internally threaded bore 85 formed in tubesheet 70. In addition, each rod 410 has a distal end portion 430. Interposed between proximal end portion 420 and distal end portion 430 of rod 410 is an intermediate portion 440 integrally formed therewith and having the same oppositely disposed parallel planer side portions 310*a* and 310*b* as stayrod arrangement 260. In addition, planer side portions 310*a*/310*b* of intermediate portion 440, which intermediate portion 440 belongs to second embodiment stayrod arrangement 400, define the same mid-portion 320 with predetermined width "A" as stayrod arrangement 260 for allowing the fluid stream 210 past side portions 310*a*/310*b* and into sludge land 55 to flush sludge 77 therefrom.

Still referring to FIG. 6, second embodiment stayrod arrangement 440 includes an anti-rotation connector 450 integrally connected to distal end portion 430 of rod 410. Connector 450 has a longitudinal internally threaded bore 460 formed in a distal end portion 470 thereof for reasons disclosed presently. Moreover, distal end portion 470 of connector 450 has the polygonally-shaped washer 360 integrally attached thereto, such as by the weldments 370. Washer 360 is matingly received in polygonally-shaped recess 148. It will be appreciated from the description hereinabove, that the mating engagement of washer 360 with recess 148 ensures that connector 330 is incapable of rotating about its longitudinal axis for reasons disclosed in more detail hereinbelow. Connector 450 is suspended and downwardly extends from baffle plate 140 to an axial elevation short of the predicted height or level of sludge deposits 77 in order not to impede or block fluid stream 210. An advantage of this second embodiment stayrod arrangement 400 is that connector 450 forms a contiguous integral part of rod 410, rather than a separate element connected to rod 410, thereby reducing the potential for a loose part in heat exchanger 10.

Figure 7:
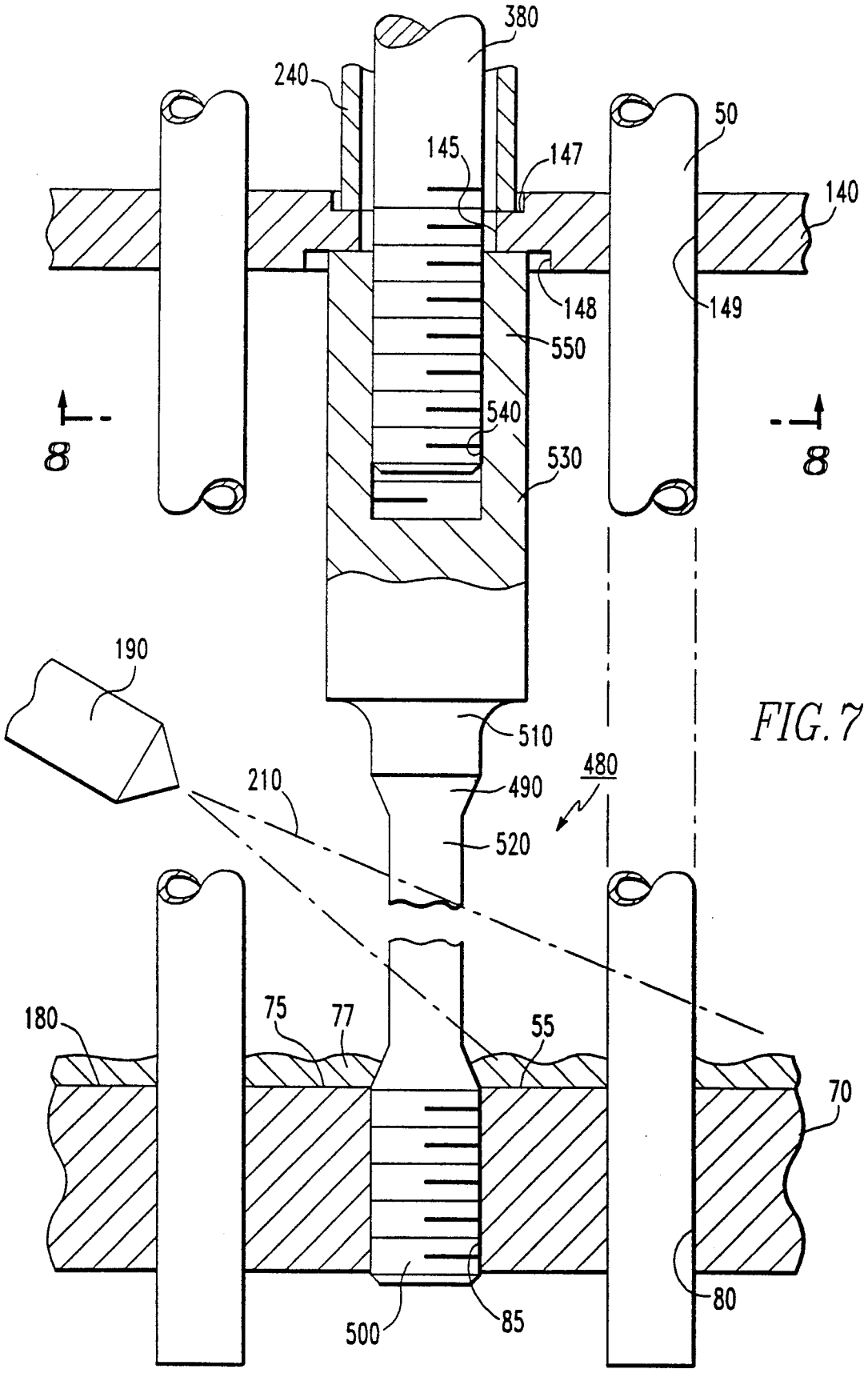
FIG. 7 is a view in partial elevation of another alternative embodiment of the stayrod arrangement belonging to the present invention.
Figure 8:
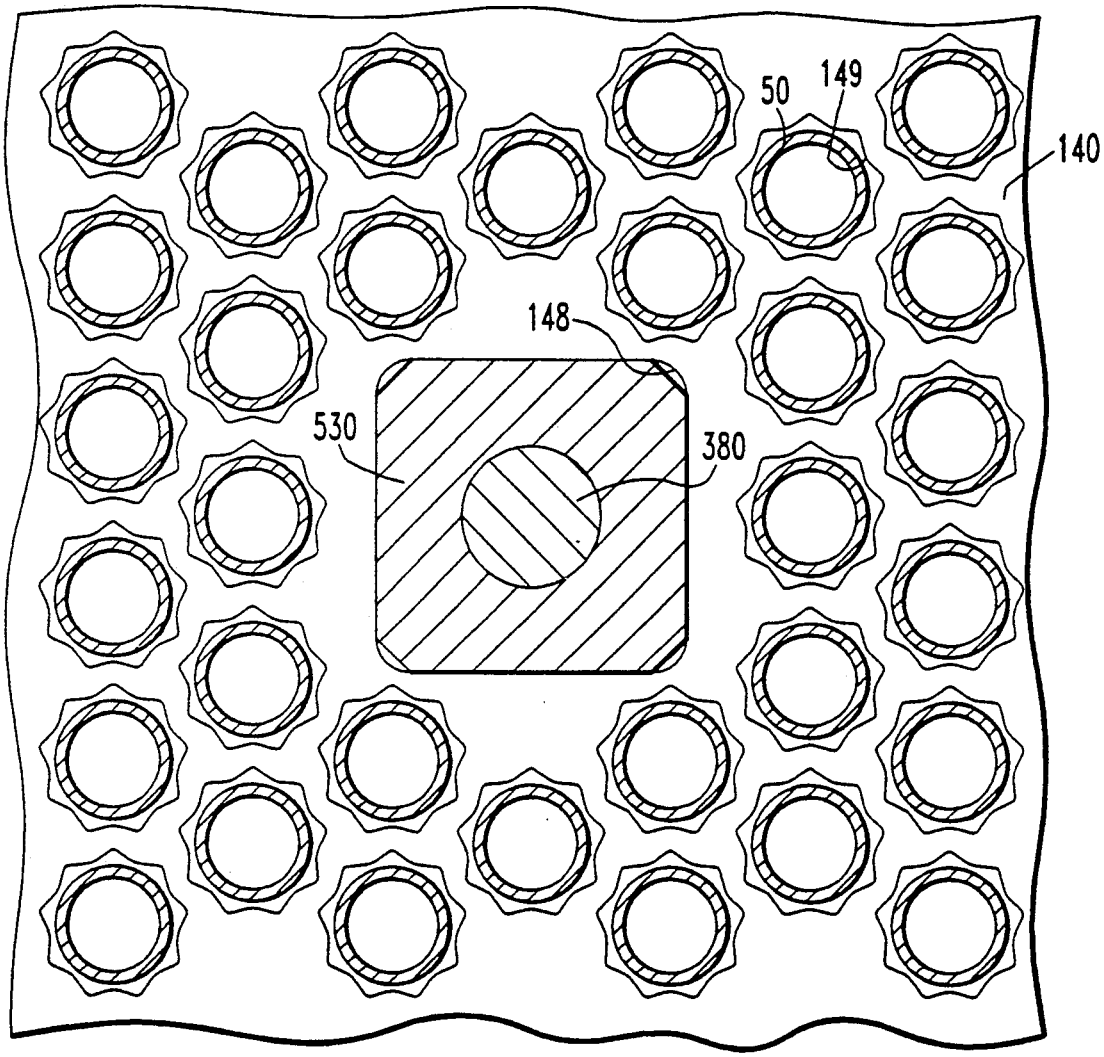
FIG. 8 is a view along section line 8—8 of FIG. 7.

Referring now to FIGS. 7 and 8, there is shown a third embodiment of the present invention, which is a third embodiment stayrod arrangement, generally referred to as 480, for enhancing removal of sludge. Third embodiment stayrod arrangement 480 comprises a plurality of elongate generally cylindrical rods 490 disposed at predetermined locations adjacent tubes 50 in such a manner as to match the pattern of tubes 50. Each rod 490 has an externally threaded proximal end portion 500 capable of threadably engaging internally threaded bore 85 formed in tubesheet 70. In addition, each rod 490 has a distal end portion 510. Interposed between proximal end portion 500 and distal end portion 510 is an intermediate portion 520 integrally formed therewith and having the same oppositely disposed parallel planer side portions 310*a*/310*b* as stayrod arrangement 260. In addition, planer side portions 310*a*/310*b* of intermediate portions 520, which belong to third embodiment stayrod arrangement 480, define the same mid-portion 320 with predetermined width "A" as stayrod arrangement 260 for allowing the fluid stream 210 past side portions 310*a*/310*b* and into tube lane 55 to flush sludge 77 therefrom.

Still referring to FIGS. 7 and 8, third embodiment stayrod arrangement 480 includes an anti-rotation connector 530 is integrally connected to distal end portion 510 of rod 490. Connector 530 has a longitudinal internally threaded bore 540 formed in a distal end portion 550 thereof for reasons disclosed presently. The distal end portion 550 of connector 530 is polygonally-shaped so that it is capable of being matingly received in polygonally-shaped recess 148. This ensures that distal end portion 550 is incapable of rotating about its longitudinal axis for reasons disclosed in more detail hereinbelow. Connector 530 is suspended and downwardly extends from baffle plate 140 to an axial elevation short of the predicted height or level of sludge deposits 77 in order not to impede or block fluid stream 210. Thus, it will be appreciated that third embodiment stayrod arrangement 480 is substantially similar to second embodiment stayrod arrangement 400 except that washer 360 is not present. An advantage of this third embodiment stayrod arrangement 480 is that connector 530 forms a contiguous integral part of rod 490, rather than a separate element connected to rod 490, thereby reducing the potential for a loose part in heat exchanger 10. In addition, washer 360 has been eliminated, thereby also reducing the potential of a loose part occurring in heat exchanger 10.

Figure 9:
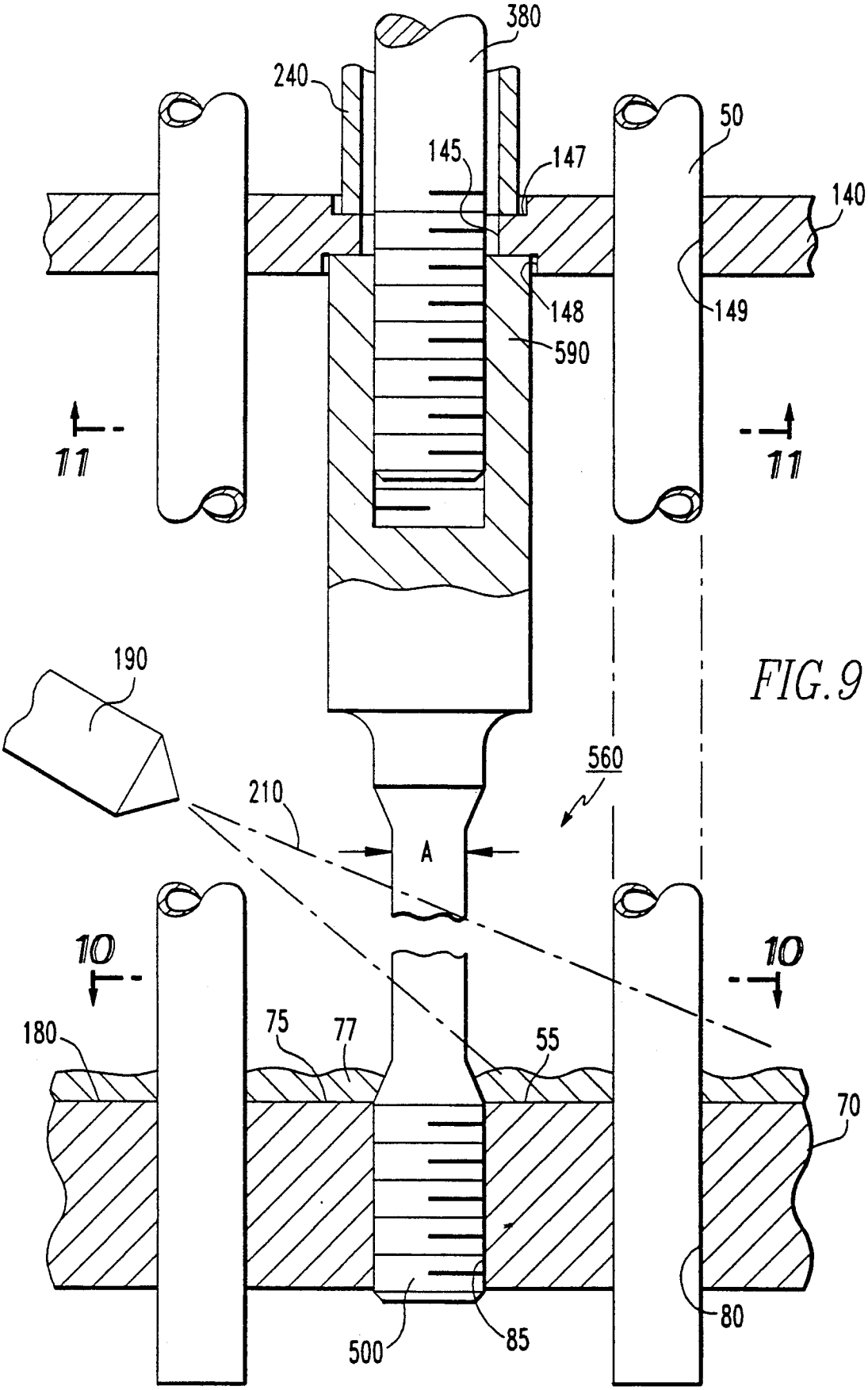
FIG. 9 is a view in partial elevation of yet another alternative embodiment of the stayrod arrangement belonging to the present invention.
Figure 10:
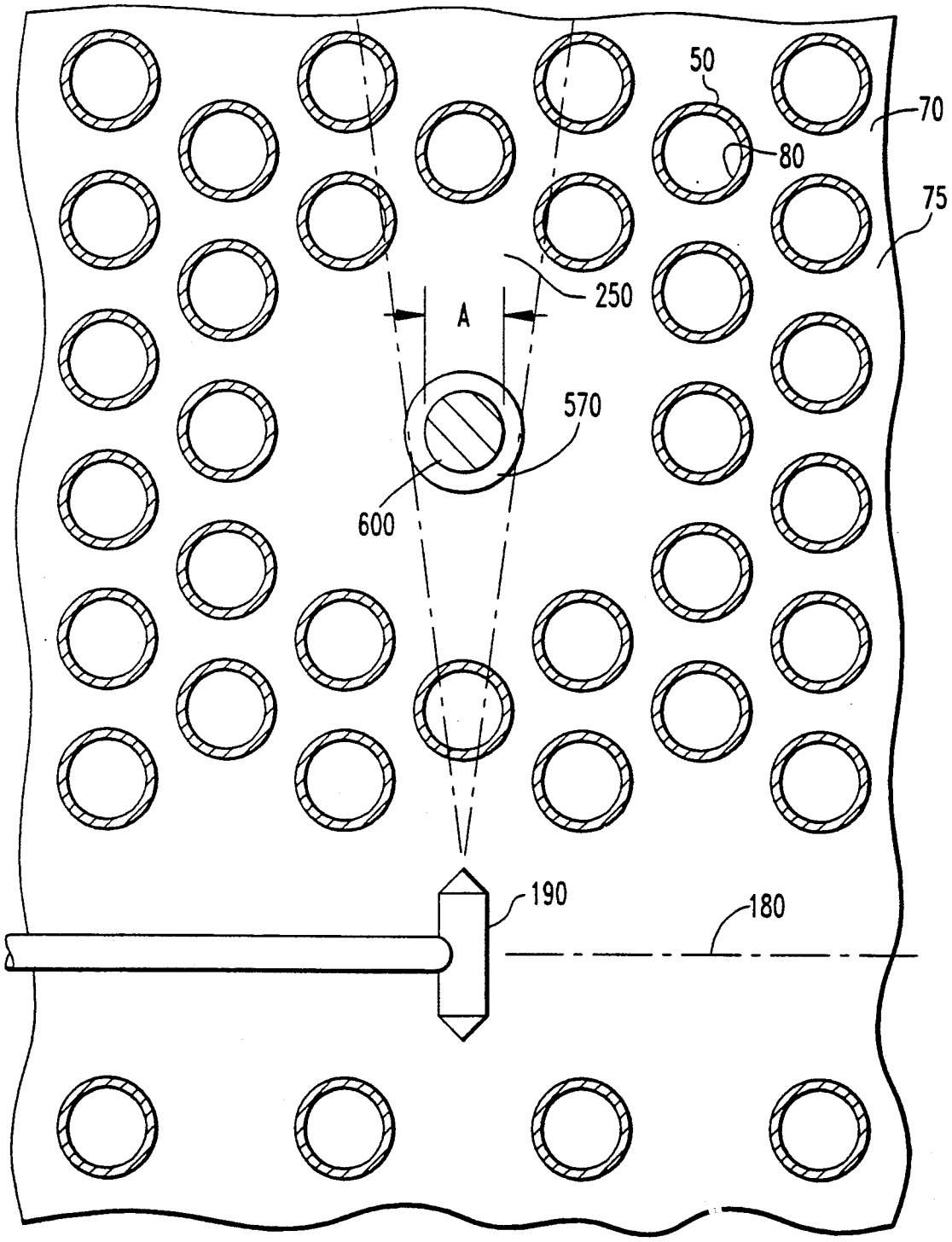
FIG. 10 is a view along section line 10—10 of FIG. 9.
Figure 11:
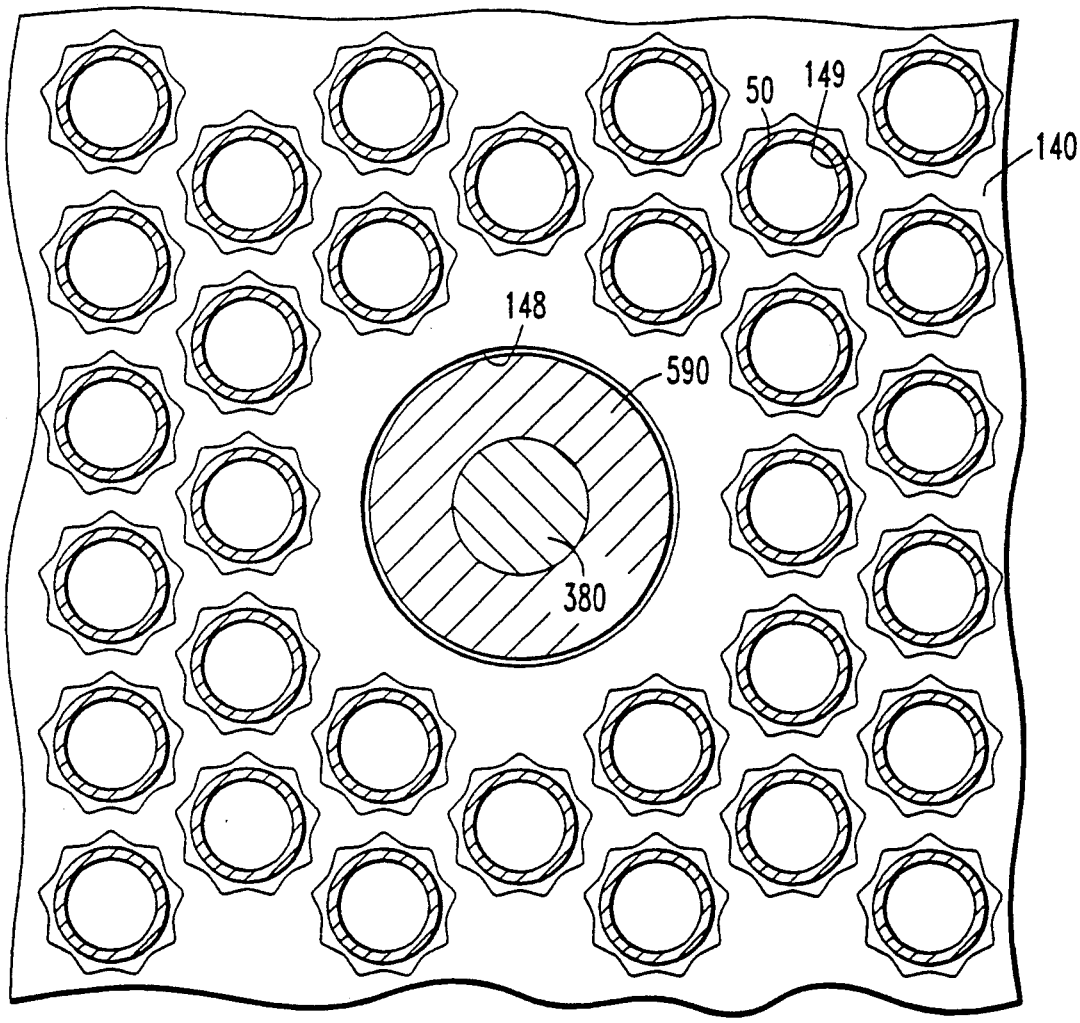
FIG. 11 is a view along section line 11 of FIG. 10.

Referring now to FIGS. 9, 10 and 11, there is shown a fourth embodiment of the present invention, which is a fourth embodiment stayrod arrangement, generally referred to as 560, for enhancing removal of sludge. Fourth embodiment stayrod arrangement 560 comprises a plurality of elongate generally cylindrical rods 570 disposed at predetermined locations adjacent tubes 50 in such a manner as to match the pattern of tubes 50. Each rod 570 has an externally threaded proximal end portion 580 capable of threadably engaging internally threaded bore 85 formed in tubesheet 70. In addition, each rod 570 has a distal end portion 590. Interposed between proximal end portion 580 and distal end portion 590 is a cylindrical intermediate portion 600 of reduced diameter "A" integrally formed therewith. In addition, the width of diameter "A" is predetermined for allowing the fluid stream 210 past reduced diameter "A" and into tube lane 55 to flush sludge 77 therefrom. An advantage of fourth embodiment 560 is that reduced diameter "A" allows fluid stream 210 therepast regardless of the direction of flow of fluid stream 210.

By way of example only, and not by way of limitation, there may be approximately 5700 of tubes 50 each having an outside diameter of about 0.687 inch to provide the necessary heat transfer surface area for suitably transferring heat from the primary fluid flowing through tubes 50 to the secondary fluid surrounding tubes 50. Each shortened rod 380 may have an outside diameter of approximately 1.00 inch for preventing deflection or bowing of support plates 60 and baffle plate 140 and each spacer 240 that surrounds its respective rod 380 may have an outside diameter of about 1.66 inches to maintain support plates 60 in their spaced-apart relationship. The planer parallel sides 310*a*/310*b* of rod 270/410/490 define width "A" therebetween of about 0.700 inch, the width "A" being approximately equal to the 0.687 inch outside diameter of each tube 50 for admitting fluid stream 210 past planer sides 310*a*/310*b* for effectively removing sludge 77 from tube lanes 55 located near tube 50. Connector 330/450/530 may have an outside diameter of approximately 1.875 inches and a length of about 4.00 inches to mitigate blockage of fluid stream 210.

OPERATION

Heat exchanger 10 is removed from service in a manner customarily used in the art and the covers (not shown) over inspection ports 130 are removed to allow access to top surface 75 of tubesheet 70. Next, fluid lance 190 is introduced into heat exchanger 10 through one of the inspection ports 130, while a suction header 200 is inserted through the inspection port 130 diametrically opposite the inspection port 130 through which the fluid lance 190 was introduced. Fluid lance 190 is then moved or translated along center tube lane 180 while emitting fluid stream 210 therefrom. This fluid stream 210 is directed toward tube lanes 55 defined between tubes 50 to dislodge or remove sludge 77 therefrom. As fluid stream 210 is directed toward tube lane 55, it will admit past parallel planer side portions 310*a*/310*b* or reduced diameter "A" in order to remove sludge 77 from portion 250 of tubesheet 70 behind rod 270/410/490/570. Sludge 77 is simultaneously suctioned from surface 75 by means of suction header 200 as fluid lance 190 is operated. After the fluid lancing operation is completed, steam generator 10 is returned to service.

It will be appreciated from the description hereinabove that an advantage of the present invention is that, when compared to the prior art, relatively more sludge is removed from the tube lane 55 by the fluid stream 210 because the reduced cross-section of the rod 270/410/490/570 will not substantially block the tube lane 77. This is so because more of fluid stream 210 will admit past rod 270/410/490/570 compared to the prior art due to the provision of planer sides 310*a*/310*b* that define the width "A" which is approximately equal to the outside diameter of tubes 50 and because the rod 270/410/490/570 match the pitch or pattern of tubes 50. It will also be appreciated from the description hereinabove that another advantage of stayrod arrangements 260/400/480/560 is that rod 270/410/490/570 is adjustable so as to customize the length of rod 270/410/490/570 to accommodate to different heights of baffle plate 140 above tubesheet 70 caused by different designs of heat exchanger 10.

Although the invention is illustrated and described herein in its preferred embodiments, it is not intended that the invention as illustrated and described be limited to the details shown, because various modifications may be obtained with respect to the invention without departing from the spirit of the invention or the scope of equivalents thereof. For example, rod 270/140/490/570 may be integrally contiguously formed with the other rod 380 in order to form a full length rod having parallel planer sides 310*a*/310*b* or reduced diameter "A" extending along an axial portion thereof. The advantage of such a configuration of stayrod arrangements 260/400/480/560 would be that connector 330/450/530 and washer 360 could be eliminated thereby reducing the potential for a loose part in heat exchanger 10.

Therefore, what is provided is a stayrod arrangement for enhancing removal of sludge from nuclear heat exchangers.

What is claimed is:

1. A stayrod arrangement for enhancing removal of sludge from a lane having the sludge therein and defined between a plurality of spaced-apart structures, the stayrod arrangement adapted to reduce blockage of a fluid directed toward the lane, comprising a rod disposed adjacent the structures and having a portion thereof of reduced transverse cross section oriented parallel to the direction of the fluid for allowing the fluid past the reduced portion and into the lane for flushing the sludge from the lane.

2. A stayrod arrangement for enhancing removal of sludge from a sludge lane having the sludge therein and defined between a plurality of tubular structures, the stayrod arrangement adapted to reduce blockage of a fluid stream directed toward the sludge lane, comprising a rod disposed adjacent the structures and having a portion thereof of reduced transverse cross section oriented parallel to the direction of the fluid stream for allowing the fluid stream past the reduced portion and into the sludge lane for flushing the sludge therefrom.

3. The stayrod arrangement of claim 2, further comprising a plate member capable of deflecting, said plate member connected to said rod so that said rod stays the deflection of said plate member.

4. The stayrod arrangement of claim 3, further comprising an antirotation connector connected to said rod and to said plate member for preventing rotation of said rod so that the reduced portion of said rod remain parallel to the fluid stream.

5. A stayrod arrangement for enhancing removal of sludge from a sludge lane having the sludge therein and defined between a plurality of tubes arranged in a predetermined pattern, the stayrod arrangement adapted to reduce blockage of a fluid stream directed toward the sludge lane for flushing the sludge therefrom, comprising:

(a) a rod disposed adjacent the tubes so as to match the pattern of the tubes and having a portion thereof of reduced transverse cross section oriented parallel to the direction of the fluid stream for allowing the fluid stream past the reduced portion and-into the sludge lane to flush the sludge therefrom, the rod having a proximal end portion and a distal end portion;

(b) a first plate member attached to the tubes and having a bore therein for receiving the proximal end portion of said rod;

(c) a second plate member spaced-apart from said first plate member, said second plate member connected to said rod so that said rod .stays the deflection of said second plate member; and (d) an anti-rotation connector interposed between said first plate member and said second plate member, said connector having a proximal end portion connected to the distal end portion of said rod and having a distal end portion connected to said second plate member for preventing rotation of said rod so that the reduced portion of said rod remains parallel to the fluid stream.

6. The stayrod arrangement of claim 5:

(a) wherein the distal end portion of said connector is polygonally-shaped; and (b) wherein said second plate member has a polygonally-shaped recess for matingly receiving the distal end portion of said connector so that said connector is incapable of rotating.

7. The stayrod arrangement of claim 6, wherein the distal end portion of said connector comprises a polygonally-shaped washer integrally attached to said connector and matingly received in the recess.

8. The stayrod arrangement of claim 7, wherein said connector has a bore therein for receiving the distal end portion of said rod to connect said first plate member to said rod.

9. The stayrod arrangement of claim 5, wherein the reduced portion of said rod defines parallel planer sides.

10. The stayrod arrangement of claim 5, wherein the reduced portion of said rod is cylindrical.

11. In a nuclear heat exchanger, a stayrod arrangement for enhancing removal of sludge deposits from a tube lane having the sludge deposits therein and defined between a plurality of heat exchange tubes having a predetermined pitch, the stayrod arrangement adapted to reduce blockage of a fluid stream directed toward the tube lane for flushing the sludge therefrom, the stayrod arrangement comprising:

(a) a plurality of elongate generally cylindrical rods adjacent the tubes so as to match the pitch of the tubes, each of said rods having a mid-portion thereof of reduced transverse cross section of predetermined width for allowing the fluid stream past the reduced portion and into the tube lane to flush the sludge deposits therefrom, each of the rods having an externally threaded proximal end portion and a distal end portion;

(b) a tubesheet attached to the tubes for supporting the tubes and having a plurality of internally threaded bores therein for threadably receiving the proximal end portion of respective ones of said rods;

(c) a baffle plate spaced-apart from said tubesheet and in cooperative association with said tubesheet for sweeping sludge from said tubesheet, said baffle plate capable of deflecting, said baffle plate connected to each of said rods so that said rods coact with said tubesheet to stay the deflection of said baffle plate, said baffle plate having a plurality of polygonally shaped recesses formed therein aligned with respective ones of the bores in said tubesheet; and (d) a plurality of anti-rotation connectors interposed between said tubesheet and said baffle plate, each of said connectors having a proximal end portion connected to the distal end portion of respective ones of said rods and having a polygonally-shaped distal end portion matingly received in its respective recess formed in said baffle plate so that each of said connectors is incapable of rotating.

12. The stayrod arrangement of claim 11, wherein the distal end portion of said connector comprises a polygonally-shaped washer integrally attached to said connector and matingly received in the recess.

13. The stayrod arrangement of claim 11:

(a) wherein each of said connectors has an internally threaded bore therein; and (b) wherein the distal end portion of each of said rods is externally threaded for threadably engaging the internally threaded bore in said connector.

14. The stayrod arrangement of claim 11, wherein the reduced portion of each of said rods defines parallel planer sides.

15. The stayrod arrangement of claim 11, wherein the reduced portion of said rod is cylindrical.

* * * * *